US008947471B2

(12) United States Patent
Oh

(10) Patent No.: US 8,947,471 B2
(45) Date of Patent: Feb. 3, 2015

(54) ACTIVE MATRIX DISPLAY AND METHOD OF DRIVING THE SAME

(75) Inventor: Choon-Yul Oh, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 608 days.

(21) Appl. No.: 13/200,338

(22) Filed: Sep. 23, 2011

(65) Prior Publication Data

US 2012/0236041 A1 Sep. 20, 2012

(30) Foreign Application Priority Data

Mar. 14, 2011 (KR) ..... 10-2011-0022396

(51) Int. Cl.
*G09G 5/10* (2006.01)
*G09G 3/32* (2006.01)

(52) U.S. Cl.
CPC ..... *G09G 3/3233* (2013.01); *G09G 3/3275* (2013.01); *G09G 2320/0223* (2013.01); *G09G 2360/16* (2013.01)
USPC ..... 345/690; 345/691; 345/692

(58) Field of Classification Search
CPC ..... G09G 3/3233; G09G 3/3275; G09G 2300/802; G09G 2300/0223; G09G 2300/043; G09G 2300/0819; G09G 2300/0852; G09G 2300/0861; G09G 2320/043; G09G 2320/0238; G09G 2320/0285; G09G 2320/0673
USPC ..... 345/76–82, 204, 211–214, 690; 257/59, 257/72, 83; 438/22, 29, 34; 315/169.1–169.3; 313/504; 327/109
See application file for complete search history.

(56) References Cited

U.S. PATENT DOCUMENTS

| | | | | |
|---|---|---|---|---|
| 6,177,914 | B1 * | 1/2001 | Iwama et al. | 345/60 |
| 6,847,172 | B2 * | 1/2005 | Suzuki | 315/169.3 |
| 7,030,842 | B2 * | 4/2006 | Ha et al. | 345/76 |
| 7,158,107 | B2 * | 1/2007 | Kawabe et al. | 345/89 |
| 8,111,216 | B2 * | 2/2012 | Chan et al. | 345/76 |
| 2002/0024481 | A1 * | 2/2002 | Kawabe et al. | 345/87 |
| 2003/0067428 | A1 * | 4/2003 | Moon | 345/87 |
| 2003/0201955 | A1 * | 10/2003 | Song et al. | 345/76 |
| 2005/0110730 | A1 * | 5/2005 | Kim et al. | 345/82 |
| 2006/0022305 | A1 * | 2/2006 | Yamashita | 257/565 |
| 2006/0028408 | A1 * | 2/2006 | Kim | 345/76 |
| 2006/0290638 | A1 * | 12/2006 | Kang et al. | 345/98 |

(Continued)

FOREIGN PATENT DOCUMENTS

| | | | |
|---|---|---|---|
| KR | 10 2003-0081610 | A | 10/2003 |
| KR | 10 2005-0005198 | A | 1/2005 |
| KR | 10 2008-0075386 | A | 8/2008 |

*Primary Examiner* — Prabodh M Dharia
(74) *Attorney, Agent, or Firm* — Lee & Morse, P.C.

(57) ABSTRACT

An active matrix display may include: a panel including a plurality of scan lines which transmit scan signals, a plurality of data lines which transmit data signals in response to the scan signals from the scan lines, a plurality of pixel circuits which are formed in a plurality of pixels, and each of the pixel circuits include a display element and a driving transistor driving the display element, and a power line which supplies a driving current to the driving transistor; a scan driver selectively transmitting the scan signals to the scan lines; a compensation circuit unit generating a compensation signal for compensating a voltage drop of the power line which results from a change in a total driving current flowing through the panel; and a data driver compensating the data signals using the compensation signal and transmitting compensated data signals to the data lines.

11 Claims, 6 Drawing Sheets

(56) References Cited

U.S. PATENT DOCUMENTS

| | | | | |
|---|---|---|---|---|
| 2007/0111369 | A1* | 5/2007 | Chun et al. | 438/99 |
| 2007/0279345 | A1* | 12/2007 | Kim | 345/80 |
| 2008/0088547 | A1* | 4/2008 | Chan et al. | 345/76 |
| 2008/0111799 | A1* | 5/2008 | Hoppenbrouwers et al. | 345/204 |
| 2008/0150846 | A1* | 6/2008 | Chung | 345/80 |
| 2008/0158115 | A1* | 7/2008 | Cordes et al. | 345/82 |
| 2009/0015521 | A1* | 1/2009 | Fish | 345/76 |
| 2009/0021287 | A1* | 1/2009 | Jang et al. | 327/109 |
| 2009/0102399 | A1* | 4/2009 | Kita | 315/307 |
| 2009/0115801 | A1* | 5/2009 | Jeon | 345/690 |
| 2009/0237393 | A1* | 9/2009 | Saito | 345/214 |
| 2010/0149083 | A1* | 6/2010 | Park et al. | 345/99 |
| 2010/0156879 | A1* | 6/2010 | Hong et al. | 345/213 |
| 2010/0156885 | A1* | 6/2010 | Cho et al. | 345/214 |
| 2010/0328301 | A1* | 12/2010 | Kim et al. | 345/214 |
| 2010/0328367 | A1* | 12/2010 | Kwak et al. | 345/690 |

* cited by examiner

ACTIVE MATRIX DISPLAY AND METHOD OF DRIVING THE SAME

This application claims priority from Korean Patent Application No. 10-2011-0022396, filed on Mar. 14, 2011, in the Korean Intellectual Property Office, the disclosure of which is incorporated herein by reference in its entirety.

BACKGROUND

1. Field

Embodiments relate to an active matrix display and a method of driving the same. More particularly, embodiments relate to an active matrix display which compensates for a voltage reduction between a gate and a source of a driving transistor, and a method of driving the active matrix display. The voltage reduction results from a drop in a power supply voltage caused by a change in a current flowing through a panel.

2. Description of the Related Art

Organic electroluminescent (EL) displays are a type of active matrix displays.

An organic EL display electrically excites a phosphorous organic compound to emit light and drives N×M organic EL cells to display images. Methods of driving the organic EL cells include a passive matrix method and an active matrix method using thin-film transistors (TFTs).

In the passive matrix method, anodes and cathodes are arranged to cross each other perpendicularly, and lines are selected to be driven. In the active matrix method, a TFT and a capacitor are coupled to each indium tin oxide (ITO) pixel electrode to maintain the voltage by capacitance.

SUMMARY

Embodiments are directed to an active matrix display and a method of driving the active matrix display.

According to an embodiment, there may be an active matrix display comprising: a panel including a plurality of scan lines which transmit scan signals, a plurality of data lines which transmit data signals in response to the scan signals from the scan lines, a plurality of pixel circuits which are formed in a plurality of pixels defined by the data lines and the scan lines, and each of the pixel circuits include a display element and a driving transistor driving the display element, and a power line which supplies a driving current to the driving transistor; a scan driver selectively transmitting the scan signals to the scan lines; a compensation circuit unit generating a compensation signal for compensating a voltage drop of the power line which results from a change in a total driving current flowing through the panel; and a data driver compensating the data signals using the compensation signal and transmitting the compensated data signals to the data lines.

According to another embodiment, there may be a method of driving an active matrix display which includes a panel including a plurality of scan lines which transmit scan signals, a plurality of data lines which transmit data signals in response to the scan signals from the scan lines, a plurality of pixel circuits which are formed in a plurality of pixels defined by the data lines and the scan lines, and each of the pixel circuits includes a display element and a driving transistor driving the display element, and a power line which supplies a driving current to the driving transistor, the method comprising: generating a compensation signal for compensating a voltage drop of the power line which results from a change in a total driving current flowing through the panel; and compensating the data signals using the compensation signal; and transmitting compensated data signals to the data lines.

BRIEF DESCRIPTION OF THE DRAWINGS

The above and other features of present embodiments will become more apparent by describing in detail exemplary embodiments thereof with reference to the attached drawings, in which.

DETAILED DESCRIPTION

Example embodiments will now be described more fully hereinafter with reference to the accompanying drawings; however, they may be embodied in different forms and should not be construed as limited to the embodiments set forth herein.

Hereinafter, exemplary embodiments of an organic electroluminescent (EL) display will be described in detail with reference to the attached drawings.

Figure 1:
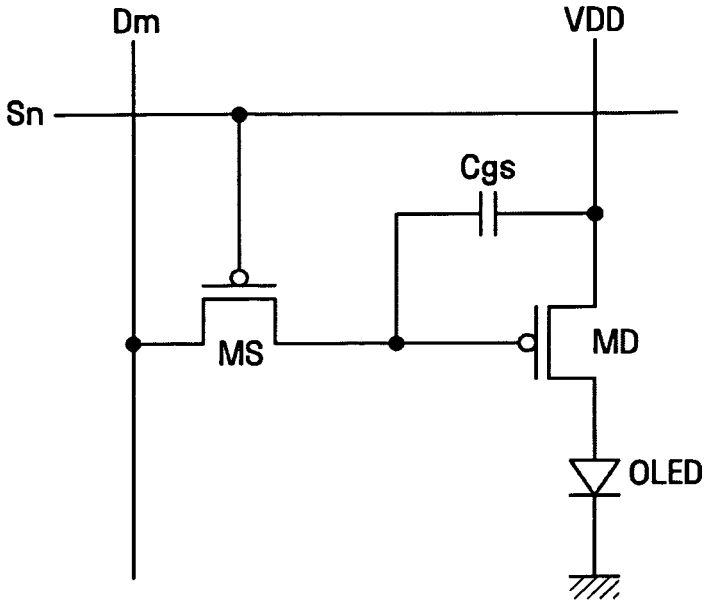
FIG. 1 illustrates a pixel circuit for driving an organic electroluminescent (EL) element using thin-film transistors (TFTs) in one of N×M pixels according to an exemplary embodiment.

FIG. 1 illustrates a pixel circuit for driving an organic EL element using thin-film transistors (TFTs) in one of N×M pixels according to an exemplary embodiment.

Referring to FIG. 1, a P-type driving transistor MD is connected to an organic EL element OLED and supplies a current for light emission to the organic EL element OLED.

The amount of current of the driving transistor MD is controlled by a data voltage applied through a P-type switching transistor MS. A capacitor Cgs that maintains the applied voltage for a certain period of time is connected between a source and a gate of the driving transistor MD. An nth scan line Sn is connected to a gate of the switching transistor MS, and a data line Dm is connected to a source of the switching transistor MS.

As to the operation of the pixel circuit structured as described above, when the switching transistor MS is turned on by a scan signal transmitted to the gate thereof, a data voltage signal VDATA is transmitted to the gate of the driving transistor MD through the data line Dm. Accordingly, a current corresponding to the transmitted data voltage signal VDATA flows to the organic EL element OLED through the driving transistor MD to allow the organic EL element OLED to emit light.

The current flowing to the organic EL element OLED may be given by Equation (1).

$$I_{OELD} = \frac{\beta}{2}(V_{GS} - V_{TH})^2 = \frac{\beta}{2}(VDD - V_{DATA} - V_{TH})^2, \quad (1)$$

where $I_{OLED}$, is the current flowing to the organic EL element OLED, $V_{GS}$, is a voltage between the source and gate of the driving transistor MD, VDD is a power supply voltage, $V_{TH}$, is a threshold voltage of the driving transistor MD, $V_{DATA}$, is a data voltage signal, and β is a constant.

As given in Equation (1), the current corresponding to the transmitted data voltage signal VDATA is supplied to the organic EL element OLED, and the organic EL element OLED emits light in response to the supplied current in the pixel circuit shown in FIG. 1. In such a case, the transmitted data voltage signal VDATA may have multi-level values within a predetermined range in order to represent grayscales.

In the above pixel circuit, the power supply voltage VDD is connected directly to the source of the driving transistor MD which is connected to an external voltage source (that outputs the power supply voltage VDD) by a power line. In addition, the power supply voltage VDD is connected in parallel to sources of driving transistors MD of the pixel circuit. Therefore, the sources of the driving transistors MD of the pixel circuits may receive almost the same power supply voltage VDD. However, when a value of the power supply voltage VDD varies according to the change in a total driving current flowing through a panel, a Vgs value of each driving transistor MD also changes, resulting in a change in the gray level of the organic EL element OLED. This will now be described in greater detail with reference to FIG. 2.

Figure 2:
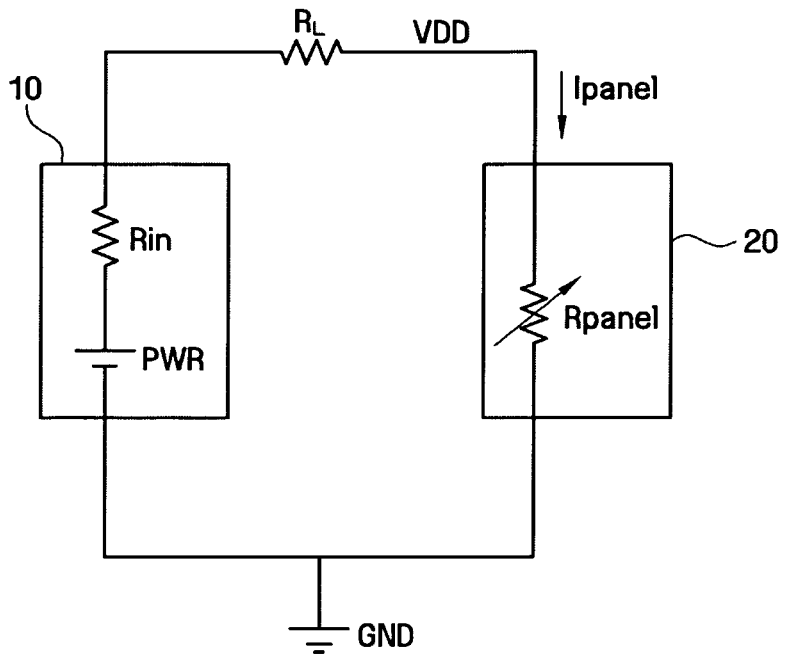
FIG. 2 is a circuit diagram mimetically illustrating the relationship between voltage variations of an active matrix display.

FIG. 2 is a circuit diagram illustrating the relationship between voltage variations of an active matrix display.

Referring to FIG. 2, a power supply unit 10 supplies the power supply voltage VDD to a panel 20 of the active matrix display. A gray level of each pixel of the panel 20 is changed by an image data signal, and a resistance $R_{PANEL}$, of the panel 20 can be understood as a variable resistance. The power supply unit 10 includes an internal resistance $R_{in}$, and a constant-voltage supplier PWR, which supplies a constant voltage $V_{PWR}$. A wiring, which supplies the power supply voltage VDD, has a resistance $R_L$.

The power supply voltage VDD may be given by Equations (2) and (3).

$$VDD = V_{PWR} - (R_L + R_{IN}) \cdot I_{PANEL}. \quad (2)$$

$$VDD = \frac{R_{PANEL}}{R_{IN} + R_L + R_{PANEL}} \cdot V_{PWR}. \quad (3)$$

Ideally, the power supply voltage VDD and the constant voltage $V_{PWR}$, of the power supply unit 10 should be equal or only slightly different. However, the power supply voltage VDD may vary according to the change in a driving current $I_{PANEL}$, of the panel 20. In particular, the power supply voltage VDD may drop sharply when the panel 20 has a maximum driving current $I_{PANEL}$, and a minimum resistance $R_{PANEL}$, in a full-white state. In this case, the Vgs value of the driving transistor MD may change, and a desired gray level may not be achieved.

Figure 3:
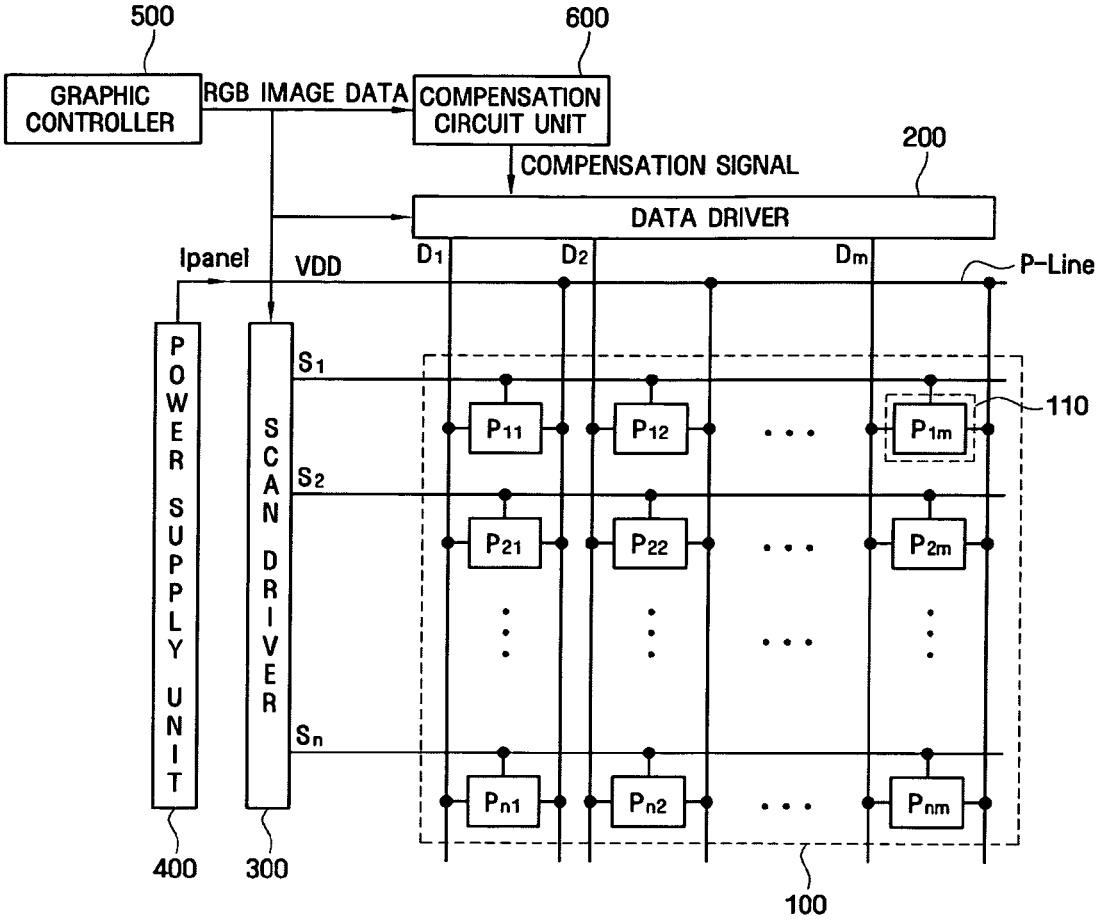
FIG. 3 illustrates an organic EL display according to an exemplary embodiment.

FIG. 3 illustrates an organic EL display according to an exemplary embodiment.

Referring to FIG. 3, the organic EL display according to the current exemplary embodiment includes an organic EL display panel 100, a data driver 200, a scan driver 300, a power supply unit 400, a graphic controller 500, and a compensation circuit unit 600.

The organic EL display panel 100 includes a plurality of scan lines S1 through Sn which transmit scan signals, a plurality of data lines D1 through Dm which transmit data signals in response to the scan signals from the scan lines S1 through Sn, a plurality of pixel circuits 100 which are formed in a plurality of pixels defined by the data lines D1 through Dm and the scan lines S1 through Sn, and a power line P-Line which supplies a driving current to the pixel circuits 110.

As shown in FIG. 1, each of the pixel circuits 110 may include an organic EL element OLED, a driving transistor MD, a switching transistor MS, and a capacitor Cgs.

The driving transistor MD is connected to the organic EL element OLED and supplies a current for light emission to the organic EL element OLED. The amount of current of the driving transistor MD is controlled by a data voltage signal transmitted through the switching transistor MS. The capacitor Cgs that maintains the applied voltage for a certain period of time is connected between a source and a gate of the driving transistor MD.

The power line P-Line may be connected in parallel to the power supply unit 400 and the driving transistor MD of each of the pixel circuits 110. The power line P-Line may apply the power supply voltage VDD to the driving transistor MD, thereby supplying a driving current for light emission of the organic EL element OLED.

The graphic controller 500 may generate RGB image data (i.e., digital image data) by itself or based on an image signal received from an external source.

The compensation circuit unit 600 receives the RGB image data generated by the graphic controller 500 and calculates a total driving current $I_{PANEL}$, flowing through the organic EL display panel 100 by analyzing image data for one screen among the RGB image data. Based on the calculated total driving current $I_{PANEL}$, the compensation circuit unit 600 generates a compensation signal for compensating for a drop in the power supply voltage VDD of the power line P-Line which is applied to the organic EL display panel 100.

The data driver 200 receives the RGB image data from the graphic controller 500 and the compensation signal from the compensation circuit unit 600, compensates a data signal for a reduction in a driving voltage of the driving transistor MD which results from a change in the power supply voltage VDD caused by a change in the total driving current $I_{PANEL}$, of the organic EL display panel 100, and transmits the compensated data signal to each of the data lines D1 through Dm. Although not shown in FIG. 3, the data driver 200 may include a latch circuit and a level shifter circuit. The latch circuit may store RGB image data received in series to transmit, in parallel, data signals to the organic EL display panel 100. The level shifter circuit may adjust a level of an actual voltage applied to the organic EL display panel 100. The specific configurations of the latch circuit and the level shifter circuit are apparent to those of ordinary skill in the art, and thus a detailed description thereof is omitted.

The scan driver 300 transmits scan signals to the scan lines Si through Sn and serves as a switch that allows data signals transmitted through the data lines D1 through Dm to reach the driving transistors MD of the pixel circuits 110 using the scan signals.

In summary, the total driving current $I_{PANEL}$, flowing through the organic EL display panel 100 varies according to the brightness or grayscale of an image (corresponding to image data) displayed on the organic EL display panel 100. The variation in the total driving current $I_{PANEL}$, leads to a change in a level of the power supply voltage VDD connected to the power line P-Line, which, in turn, results in a change in a value of a voltage Vgs applied between the gate and source of each driving transistor MD. Consequently, a gray level of each pixel cannot be expressed according to the original image data. However, a change in the total driving current $I_{PANEL}$, is sensed, and data signals of the data driver 200 compensate for a drop in the power supply voltage VDD. Therefore, the above problem can be overcome.

Figure 4:
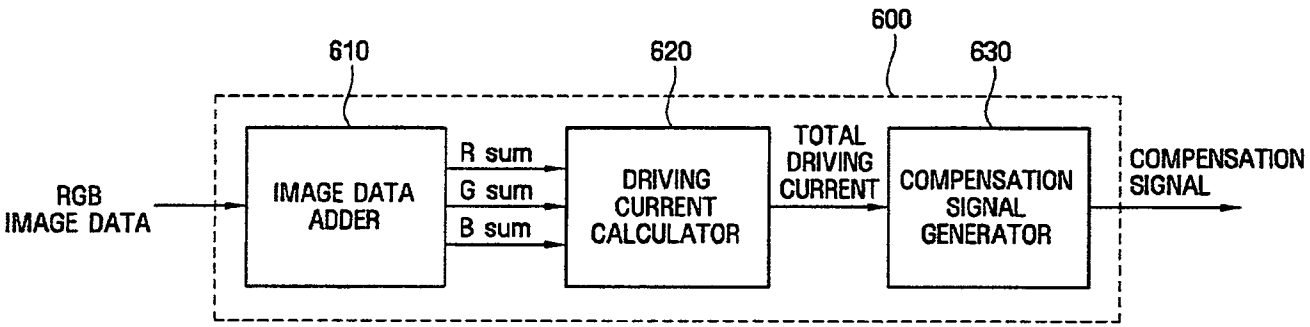
FIG. 4 is a block diagram of a compensation circuit unit shown in FIG. 3.

The specific configuration of the compensation circuit unit 600 will now be described with reference to FIG. 4. FIG. 4 is a block diagram of the compensation circuit unit 600 shown in FIG. 3.

Referring to FIG. 4, the compensation circuit unit 600 according to the current exemplary embodiment may include an image data adder, a driving current calculator, and a compensation signal generator.

The image data adder receives RGB image data from the graph controller 500 and adds image data for each of the R, G and B pixel groups for one screen among the RGB image data. Here, adding of the image data for each of the R, G, and B pixel groups may denote dividing the organic EL elements OLEDs into red, green and blue organic EL elements OLEDs and adding brightness or gray values of pixels including organic EL elements OLEDs of the same color. Accordingly, the image data adder may generate R sum, G sum, and B sum, each of which is a value obtained by adding gray values of pixels including the red, green, or blue organic EL elements OLEDs.

The driving current calculator receives the added image data R sum, G sum or B sum for each of the R, G, and B pixel groups and calculates the total driving current $I_{PANEL}$, flowing through the entire organic EL display panel 100 based on the added image data R sum, G sum, or B sum for each of the R, G and B pixel groups. For example, the driving current calculator may calculate the total driving current $I_{PANEL}$, by multiplying the added image data R sum, G sum, or data B sum for each of the R, G, and B pixel groups by a current per unit gray level for a corresponding group of pixels including the red, green, or blue organic EL elements OLEDs. Specifically, a current per unit gray level for the pixel circuits 110 including the red organic EL elements OLEDs may be defined as an R current, a current per unit gray level for the pixel circuits 110 including the green organic EL elements OLEDs may be defined as a G current, and a current per unit gray level for the pixel circuits 110 including the blue organic EL elements OLEDs may be defined as a B current. The total driving current $I_{PANEL}$, may be given by Equation (4) below.

$$\text{Total driving current}=(R,\ \text{sum}\times R,\ \text{current})+(G,\ \text{sum}\times G,\ \text{current})+(B,\ \text{sum}\times B,\ \text{current}) \quad (4).$$

The pixels including the organic EL elements OLEDs of different colors are grouped according to color, and a current value per unit gray level for each color (i.e., each pixel group) is multiplied by the sum R sum, G sum or B sum of gray values of pixels in a corresponding pixel group to obtain the total driving current $I_{PANEL}$.

However, the case where the driving current calculator calculates the total driving current $I_{PANEL}$, as described above is merely an embodiment, and present embodiments are not limited to this embodiment.

In present embodiments, the total driving current $I_{PANEL}$, corresponding to the added RGB image data may be calculated not only by using an equation, but also by using a lookup table.

Based on the calculated total driving current $I_{PANEL}$, the compensation signal generator generates a compensation signal for compensating for a drop in the power supply voltage VDD of the power line P-Line, which results from a change in the total driving current $I_{PANEL}$, flowing through the organic EL display panel 100.

The compensation signal may be a voltage signal corresponding to a drop in the power supply voltage VDD of the power line P-Line, and the drop in the power supply voltage VDD of the power line P-Line may be given by Equation (5) below.

$$\text{Drop in power supply voltage}=(\text{Voltage drop in full-white state})\times(\text{Calculated total driving current})/(\text{Total driving current in full-white state}) \quad (5).$$

A state in which the entire pixel circuits 110 of the organic EL display panel 100 emit light at a maximum gray level may be defined as a full-white state. The total driving current $I_{PANEL}$, and a drop in the power supply voltage VDD in the full-white state may be measured in advance. The measured total driving current $I_{PANEL}$, and the measured drop in the power supply voltage VDD may be compared with a circuit corresponding to the above equation or a lookup table generated by the above equation. In this way, a compensation signal for a drop in the power supply voltage VDD of the power line P-Line can be generated.

In the above embodiment, to compensate data signals of the data driver 200 for a drop in the power supply voltage VDD resulting from a change in the total driving current $I_{PANEL}$, the compensation circuit unit 600 receives RGB image data in parallel with the data driver 200 and transmits a compensation signal for compensating for a drop in the power supply voltage VDD to the data driver 200. However, present embodiments are not limited thereto. Present embodiments encompasses all embodiments in which the compensation circuit unit 600 senses the total driving current $I_{PANEL}$, flowing through the organic EL display and compensates data signals generated by the data driver 200 based on the sensed total driving current $I_{PANEL}$.

Hereinafter, other embodiments in which the compensation circuit unit 600 senses the total driving current $I_{PANEL}$, and compensates data signals generated by the data driver 200 based on the sensed total driving current $I_{PANEL}$, will be described with reference to FIGS. 5 and 6.

Figure 5:
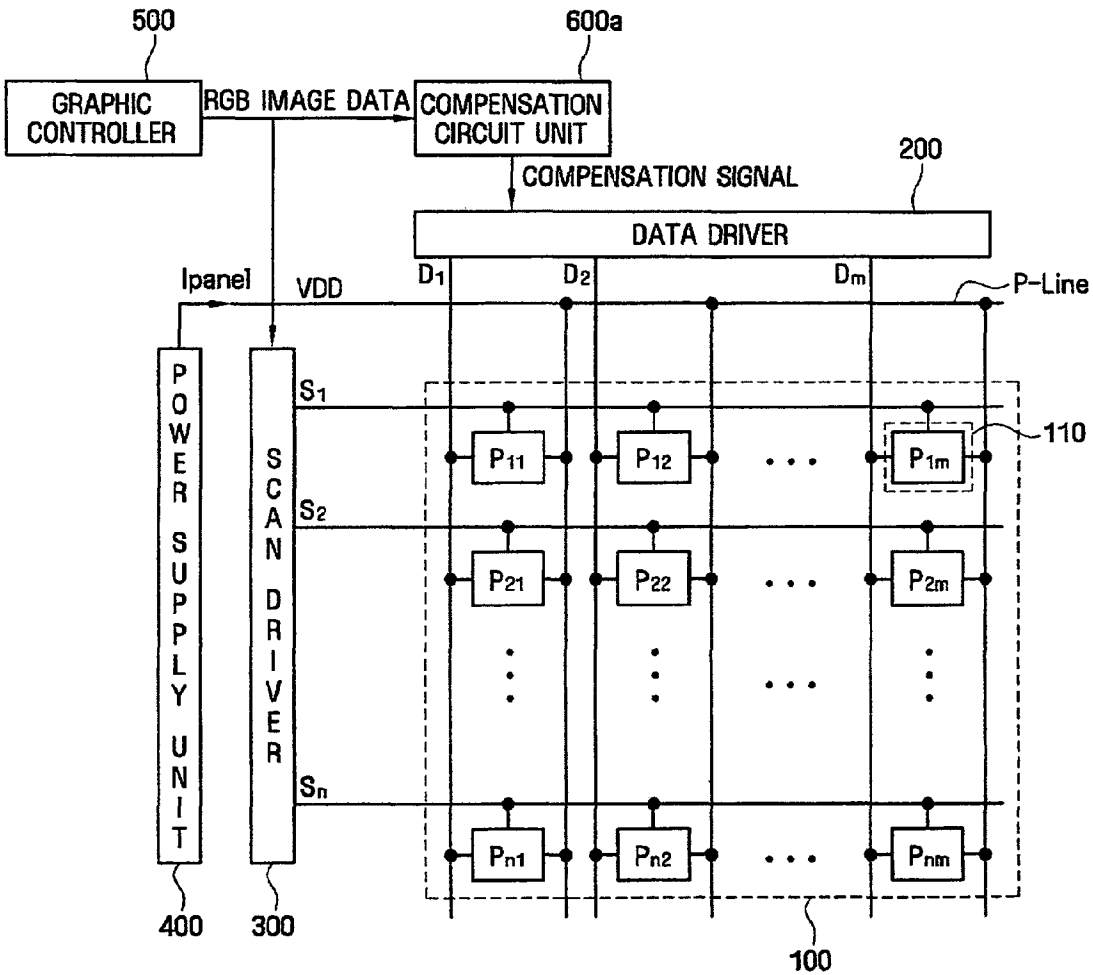
FIG. 5 illustrates an organic EL display according to another exemplary embodiment.

FIG. 5 illustrates an organic EL display according to another exemplary embodiment. Elements substantially identical to those of FIG. 3 are indicated by like reference numerals, and thus their description will be omitted.

Referring to FIG. 5, the organic EL display according to the current exemplary embodiment is different from the organic EL display according to the previous exemplary embodiment in that a compensation circuit unit 600*a*, receives RGB image data, compensates the received RGB image data, and sends the compensated RGB image data to a data driver 200 as a compensation signal.

The compensation circuit unit 600*a*, compensates the RGB image data for a drop in a power supply voltage VDD which results from a change in a total driving current $I_{PANEL}$, of an organic EL display panel 100 and sends the compensated RGB image data to the data driver 200. Accordingly, the data driver 200 does not require an additional circuit for collecting original RGB image data and the compensation signal generated by the compensation circuit unit 600*a*,, unlike the data driver 200 according to the previous embodiment. Any repetitive detailed description of elements and features identical to those of the previous exemplary embodiment is omitted.

Figure 6:
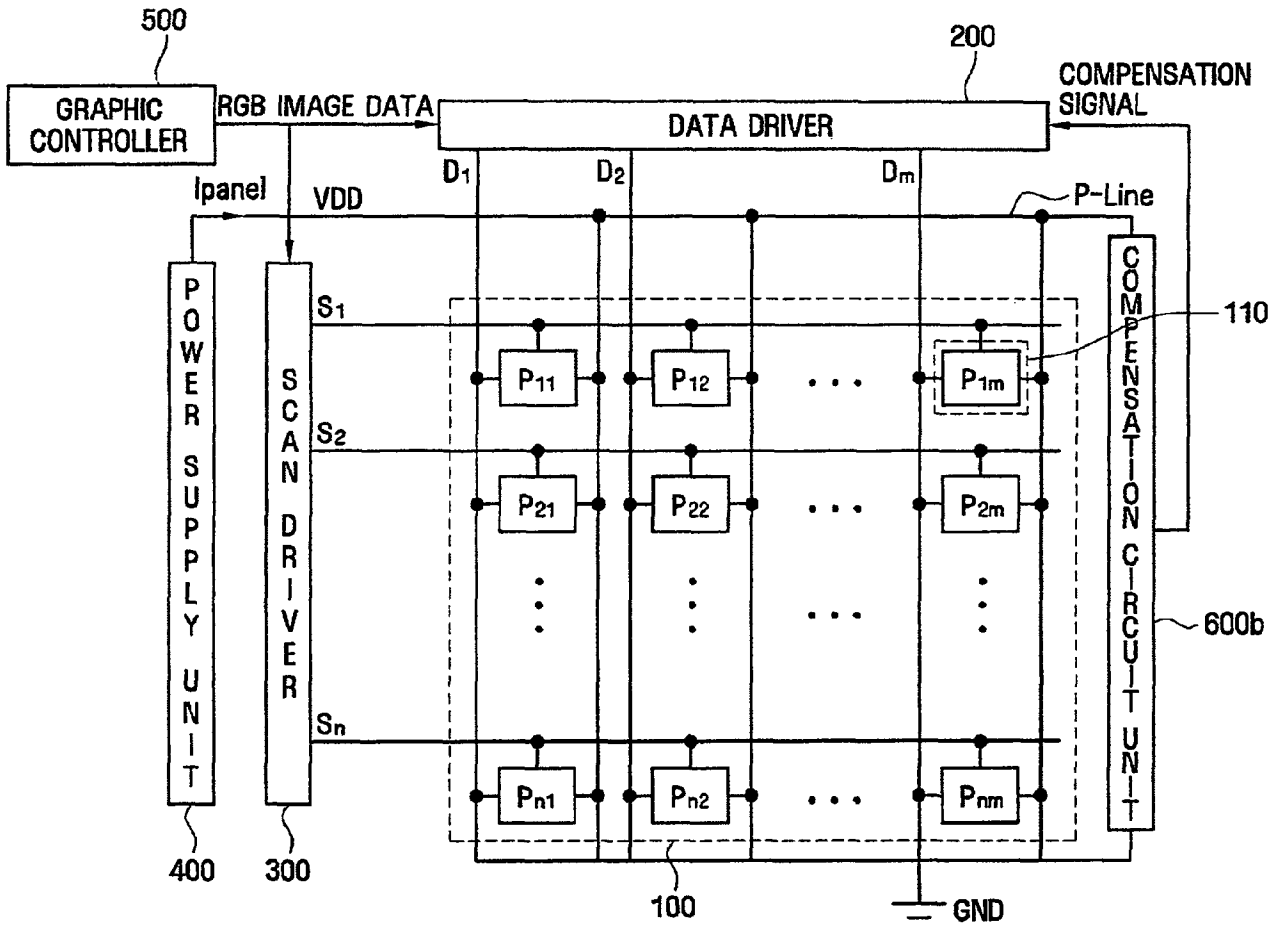
FIG. 6 illustrates an organic EL display according to another exemplary embodiment.

FIG. 6 illustrates an organic EL display according to another exemplary embodiment. Elements substantially identical to those of FIG. 3 are indicated by like reference numerals, and thus their description will be omitted.

Referring to FIG. 6, the organic EL display according to the current exemplary embodiment is different from the organic EL display according to the previous exemplary embodiment of FIG. 3 in that a compensation circuit unit 600*b*, is connected to a power line P-Line, senses a total driving current $I_{PANEL}$, flowing through an organic EL display panel 100 from the power line P-Line, and generates a compensation signal for compensating for a drop in a power supply voltage VDD of the power line P-Line which results from a change in the total driving current $I_{PANEL}$, based on the sensed total driving current $I_{PANEL}$.

In FIG. 6, the compensation circuit unit 600*b*, is connected in parallel to the organic EL display panel 100 and the power line P-Line. However, present embodiments are not limited thereto. The compensation circuit unit 600*b*, may also be connected in series between the power line P-Line of the organic EL display panel 100 and a power supply unit 400 or between the power line P-Line of the organic EL display panel 100 and a ground source GND.

Specifically, the compensation circuit unit 600*b*, may sense the total driving current $I_{PANEL}$, flowing through the organic EL display panel 100 and generate a compensation signal for data signals of a data driver 200 by calculating a drop in the power supply voltage VDD. The compensation circuit unit 600*b*, connected to the power line P-Line in parallel with the organic EL display panel 100 may sense the total driving current $I_{PANEL}$, for example, by directly sensing a change in a voltage applied thereto. The power supply voltage VDD applied to the organic EL display panel 100 may be applied in parallel to the compensation circuit unit 600*b*, without any change. Accordingly, the compensation circuit unit 600*b*, can directly sense, that is, measure a drop in the power supply voltage VDD which results from a change in the total driving current $I_{PANEL}$. Then, the compensation circuit unit 600*b*, generates a compensation signal based on the sensed drop in the power supply voltage VDD and transmits the compensation signal to the data driver 200.

In summary, the current exemplary embodiment has a feedback structure. That is, the compensation circuit unit 600*b*, connected in series and/or in parallel to the power line P-Line directly senses a drop in the power supply voltage VDD, which results from a change in the total driving current $I_{PANEL}$, flowing through the organic EL display panel 100, using a voltage and/or current measurement method, generates a compensation signal corresponding to the sensed drop in the power supply voltage VDD of the power line P-Line, and transmits the compensation signal to the data driver 200.

In the above-described embodiments, a circuit unit generating a compensation signal for compensating for a drop in a power supply voltage VDD of a power line is used in an organic EL display. However, present embodiments can also be used in an active matrix display. The circuit unit described in the embodiments can be used in an active matrix display.

By way of summation and review, when the luminance of a large-screen television using the active matrix method and organic EL cells is increased, a current flowing through the television sharply increases. In response to the increased current, a power supply voltage applied to an organic EL panel is reduced by an internal resistance of a power supply unit and a resistance of a supply wiring. Accordingly, gray levels of organic EL pixels can be distorted.

In an active matrix display and a method of driving the same according to exemplary embodiments, a change in a power supply voltage of a power line resulting from a change in a total driving current with respect to the luminance of an image displayed on the display is compensated for. Accordingly, each pixel can represent a desired gray level.

Exemplary embodiments have been disclosed herein, and although specific terms are employed, they are used and are to be interpreted in a generic and descriptive sense only and not for purpose of limitation.

What is claimed is:

1. An active matrix display, comprising:

a panel including a plurality of scan lines which transmit scan signals, a plurality of data lines which transmit data signals in response to the scan signals from the scan lines, a plurality of pixel circuits which are formed in a plurality of pixels defined by the data lines and the scan lines, and each of the pixel circuits include a display element and a driving transistor driving the display element, and a power line which supplies a driving current to the driving transistor;

a scan driver selectively transmitting the scan signals to the scan lines;

a compensation circuit unit receiving RGB image data from a controller and generating a compensation signal for compensating a voltage drop of the power line which results from change in a total driving current flowing through the panel; and a data driver receiving the RGB image data from the controller and compensating the RGB image data applying the compensation signal from the compensation circuit unit to the RGB image and transmitting compensated data signals to the data lines, wherein the compensation circuit unit receives the RGB image data in parallel with the data driver and transmits the compensation signal to the data driver.

2. The display as claimed in claim 1, wherein the compensation circuit unit: calculates the total driving current flowing through the panel by analyzing image data for an image displayed on the panel, generates the compensation signal for compensating the voltage drop of the power line which results from the change in the total driving current flowing through the panel based on the total driving current, and compensates the data signals using the compensation signal.

3. The display as claimed in claim 2, wherein the compensation circuit unit includes:

an image data adder adding red (R) image data, green (G) image data, and blue (B) image data for each of the R, G, and B pixel groups for one screen among the image data for the image displayed on the panel;

a driving current calculator calculating the total driving current flowing through the panel based on the red (R) image data, green (G) image data, and blue (B) image data for each of the R, G and B pixel groups; and a compensation signal generator generating the compensation signal for compensating the voltage drop of the power line which results from the change in the total driving current flowing through the panel based on the total driving current.

4. The display as claimed in claim 3, wherein the compensation signal corresponds to the voltage drop of the power line, the voltage drop of the power line is given by:

Voltage drop of power line=(Voltage drop in full-white state)×(Calculated total driving current) / (Total driving current in full-white state), wherein the full-white state is a state in which the display element of each of the pixel circuits emit light at a maximum intensity.

5. The display as claimed in claim 1, wherein the compensation circuit unit is connected to the power line, senses the total driving current flowing through the panel from the power line, and compensates the data signals using the compensation signal for compensating the voltage drop of the power line which results from the change in the total driving current.

6. The display as claimed in claim 5, wherein the compensation circuit unit senses the change in the total driving current by sensing a change in a voltage applied thereto.

7. The display as claimed in claim 5, wherein the compensation signal corresponds to the voltage drop of the power line, the voltage drop of the power line is given by:

Voltage drop of power line=(Voltage drop in full-white state)×(Calculated total driving current) / (Total driving current in full-white state), wherein the full-white state is a state in which the display element of each of the pixel circuits emit light at a maximum intensity.

8. A method of driving an active matrix display which includes a panel including a plurality of scan lines which transmit scan signals, a plurality of data lines which transmit data signals in response to the scan signals from the scan lines, a plurality of pixel circuits which are formed in a plurality of pixels defined by the data lines and the scan lines, and each of the pixel circuits includes a display element and a driving transistor driving the display element, and a power line which supplies a driving current to the driving transistor, the method comprising:

supplying RGB image data from a controller to a compensation circuit unit and to a data driver;

generating a compensation signal for compensating a voltage drop of the power line which results from a change in a total driving current flowing through the panel;

compensating the RGB image data applying the compensation signal to the RGB image; and transmitting compensated data signals to the data lines, wherein the compensation circuit unit receives the RGB image data in parallel with the data driver and transmits the compensation signal to the data driver.

9. The method as claimed in claim 8, wherein generating the compensation signal includes:

the total driving current flowing through the panel is calculated by analyzing image data for an image displayed on the panel, and the compensation signal for compensating the voltage drop of the power line which results from the change in the total driving current flowing through the panel is generated based on the total driving current.

10. The method as claimed in claim 8, wherein the compensation signal corresponds to the voltage drop of the power line, the voltage drop of the power line is given by:

Voltage drop of power line=(Voltage drop in full-white state)×(Calculated total driving current) / (Total driving current in full-white state), wherein the full-white state is a state in which the display element of each of the pixel circuits emit light at a maximum intensity.

11. The method as claimed in claim 10, further comprising:

detecting whether the total driving current of the panel is a maximum driving current;

detecting whether a resistance of the panel in the full-white state is a minimum resistance;

calculating the compensation signal based on a calculation of a change in a voltage value when the total driving current is the maximum driving current and the resistance of the panel in the full-white state is the minimum resistance; and applying the compensation signal to the data signals.

* * * * *